US007350335B2

(12) United States Patent
Suzuki

(10) Patent No.: US 7,350,335 B2
(45) Date of Patent: Apr. 1, 2008

(54) VEHICLE SLIDE DOOR APPARATUS

(75) Inventor: Nobuji Suzuki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 152 days.

(21) Appl. No.: 11/151,649

(22) Filed: Jun. 14, 2005

(65) Prior Publication Data

US 2005/0279025 A1 Dec. 22, 2005

(30) Foreign Application Priority Data

Jun. 21, 2004 (JP) ..... 2004-182369
Jun. 8, 2005 (JP) ..... 2005-168657

(51) Int. Cl.
*E05F 11/00* (2006.01)

(52) U.S. Cl. ..... 49/360; 296/155

(58) Field of Classification Search ..... 49/209, 49/213, 360, 483.1; 296/148, 149, 155, 207, 296/146.1, 146.5, 146.9
See application file for complete search history.

(56) References Cited

U.S. PATENT DOCUMENTS 5,626,384 A * 5/1997 Walther ..... 296/155
6,206,455 B1 * 3/2001 Faubert et al. ..... 296/155
6,791,723 B1 * 9/2004 Vallmajo et al. ..... 358/488

FOREIGN PATENT DOCUMENTS

JP 11-157339 6/1999

* cited by examiner

*Primary Examiner*—Jerry Redman
(74) *Attorney, Agent, or Firm*—Smith, Gambrell & Russell, LLP

(57) ABSTRACT

A slide door is stably supported at the rearmost position in a movable range thereof. A slide door apparatus of the invention includes a slide door which opens and closes an opening by moving in the front-and-rear direction, an upper rail extending along an upper side of the opening, an upper arm guided at one end by the upper rail and fixed at the other end to the slide door, a stopper member which comes to the proximity of the upper arm when the slide door is moved to the rearmost position in the movable range, and two stopper pins formed on the upper arm 8 so as to project therefrom and being received by the stopper member when in a state in which the upper arm is in the proximity of the stopper member.

21 Claims, 14 Drawing Sheets

VEHICLE SLIDE DOOR APPARATUS

CROSS REFERENCE TO RELATED APPLICATIONS

The disclosure of Japanese Application No.2005-168657 filed on Jun. 8, 2005 including the specification, drawing and abstract is incorporated herein by reference in its entirety.

BACKGROUND OF THE INVENTION

1. Field of the Invention

The present invention relates to a vehicle slide door apparatus for opening and closing an opening formed on a side of a vehicle body by a slide door which moves in the front-and-rear direction.

2. Description of the Related Art

Generally, in motor vehicles such as of one-box type in the related art, an opening formed on a side of a vehicle body is opened and closed by a slide door. The slide door is adapted to be guided in the front-and-rear direction by three rails provided in parallel (for example, see JP-A-11-157339). An upper rail and a lower rail of the three rails are installed on the vehicle body and a center rail is installed on the slide door.

The upper rail and the slide door are connected by an upper arm extending substantially in the lateral direction. The upper rail extends in the front-and-rear direction along an upper side of the opening on the vehicle body and guides one end of the upper arm in the front-and-rear direction. The other end of the upper arm is fixed to a pillar portion of the slide door. One end and the other end of the upper arm are connected so as to be capable of relative rotation about a center axis extending in the front-and-rear direction, so that relative displacement of the one end and the other end is allowed when the slide door is moved in the front-and-rear direction.

The upper arm is formed with a single stopper pin which is received by a stopper member provided on the upper rail when the slide door is at the rearmost position in the movable range. Accordingly, the position of the slide door is fixed when the slide door is moved to the rearmost position.

However, in the above-described vehicle slide door apparatus, since the slide door is supported by the single stopper pin when the slide door is located at the rearmost position in the movable range, when a load is applied to the upper arm from the stopper member, relatively large moment is exerted. As described above, since the upper arm is adapted to be capable of pivotal movement in the vertical direction, there is such a problem that the upper arm pivots when a load is applied thereto and hence the entire slide door becomes unstable.

In other words, when a passenger opens the slide door, the slide door hits against the stopper member at the rearmost position in the movable range, and hence a load is applied from the stopper member to the stopper pin, which generates a moment and results in unstableness of the entire slide door.

SUMMARY OF THE INVENTION

In view of such circumstances, it is an object of the invention to provide a vehicle slide door apparatus which can support a slide door stably at the rearmost position in the movable range.

In order to achieve the aforementioned object, a first aspect of the invention includes a slide door moving in a front-and-rear direction of the vehicle for opening and closing a opening formed on a side of the vehicle a rail provided on the vehicle body with extending along one of an upper side and a lower side of the opening, an arm guided by the rail in the front-and-rear direction at one end thereof and fixed to the slide door at another end thereof, a proximity member contacting to the arm when the slide door is moved to a rearmost position in a movable range of the slide door, a first projection formed on one of the arm and the proximity member so as to project therefrom for being received by the other one of those in a state in which the arm is contacted to the proximity member, and a second projection formed on the one of the arm and the proximity member at a distance from the first projection in a longitudinal direction of the arm for being received by the other one of those in a state in which the arm is contacted to the proximity member.

Preferably, one of the first projection and the second projection is formed on the arm and the other one of those is formed on the proximity member.

In this arrangement, when the slide door is moved to the rearmost position in the movable range of the slide door, the arm and the proximity members are positioned by the first projection and the second projection. At this time, since the respective projections are apart from each other, even when a load is applied to the arm side from the proximity member side, the load from the proximity member side can be received by a predetermined span basis, whereby the arm is prevented from being excessively twisted, and the moment generated on the arm can be reduced.

Therefore, even with a structure in which the arm is pivoted, the slide door can be supported stably at the rearmost position in the movable range. In other words, for example, even when the door is opened or closed by a passenger, the slide door is prevented from being unstable and hence quietness in opening and closing the door can be improved.

A second aspect of the invention includes a slide door moving in a front-and-rear direction of the vehicle for opening and closing a opening formed on a side of the vehicle, a rail provided on the vehicle body with extending along one of an upper side and a lower side of the opening, an arm guided by the rail in the front-and-rear direction at one end thereof and fixed to the slide door at another end thereof, a proximity member contacting to the arm when the slide door is moved to a rearmost position in a movable range of the slide door, and a projection which is formed on one of the arm and the proximity member so as to project therefrom and extend in a longitudinal direction of the arm for being received by the other one of those in a state in which the arm is contacted to the proximity member.

In this arrangement, when the slide door is moved to the rearmost position in the movable range of the slide door, the arm and the proximity member are positioned by the projection. Since the projection here is formed so as to extend in a longitudinal direction of the arm, even when a load is applied from the proximity member side to the arm side, the load from the proximity member side can be received by a predetermined span basis, whereby the arm is prevented from being excessively twisted, and the moment generated on the arm can be reduced.

Therefore, even with a structure in which the arm is pivoted, the slide door can be stably supported at the rearmost position in the movable range. In other words, for example, even when the door is opened or closed by the passenger, the slide door is prevented from being unstable and hence quietness in opening and closing the door can be improved.

Preferably, the first projection and the second projection are two stopper pins extending substantially in parallel with each other.

In this arrangement, the slide door can be stably supported at the rearmost position in the movable range by a minimum projecting portion by employing the stopper pins as the respective projections.

Preferably, the respective stopper pins extend at least in the direction of the width of the arm.

In this arrangement, the arm is reinforced by the respective stopper pins, and hence rigidity and strength of the arm is improved. At this time, since the respective stopper pins extend over the direction of the width of the arm, rigidity and strength can be improved not only locally, but also entirely, which is quite advantageous for practical use.

DESCRIPTION OF THE PREFERRED EMBODIMENTS

Figure 1:
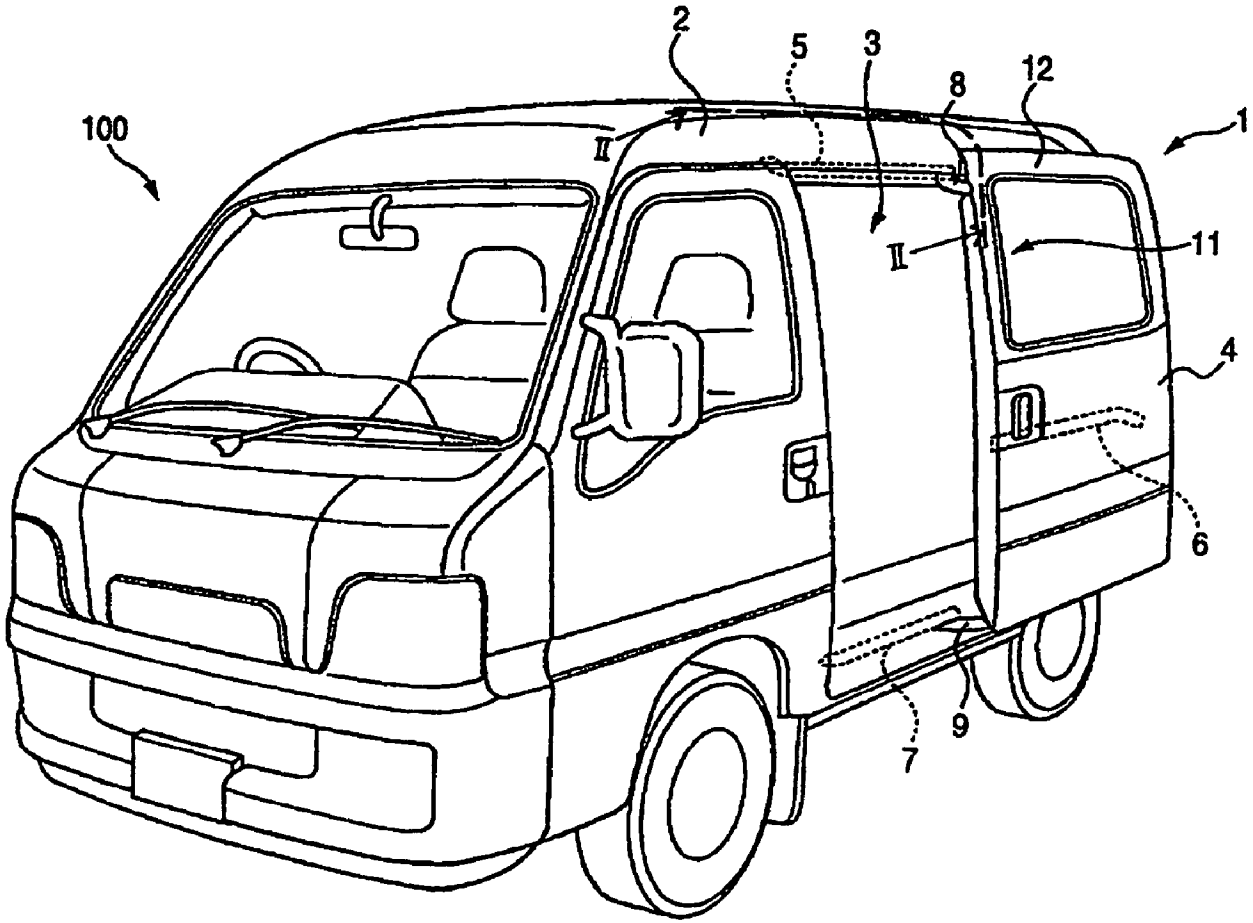
FIG. 1 is a perspective view of a general appearance of a motor vehicle provided with a slide door apparatus according to an embodiment of the invention.
Figure 2:
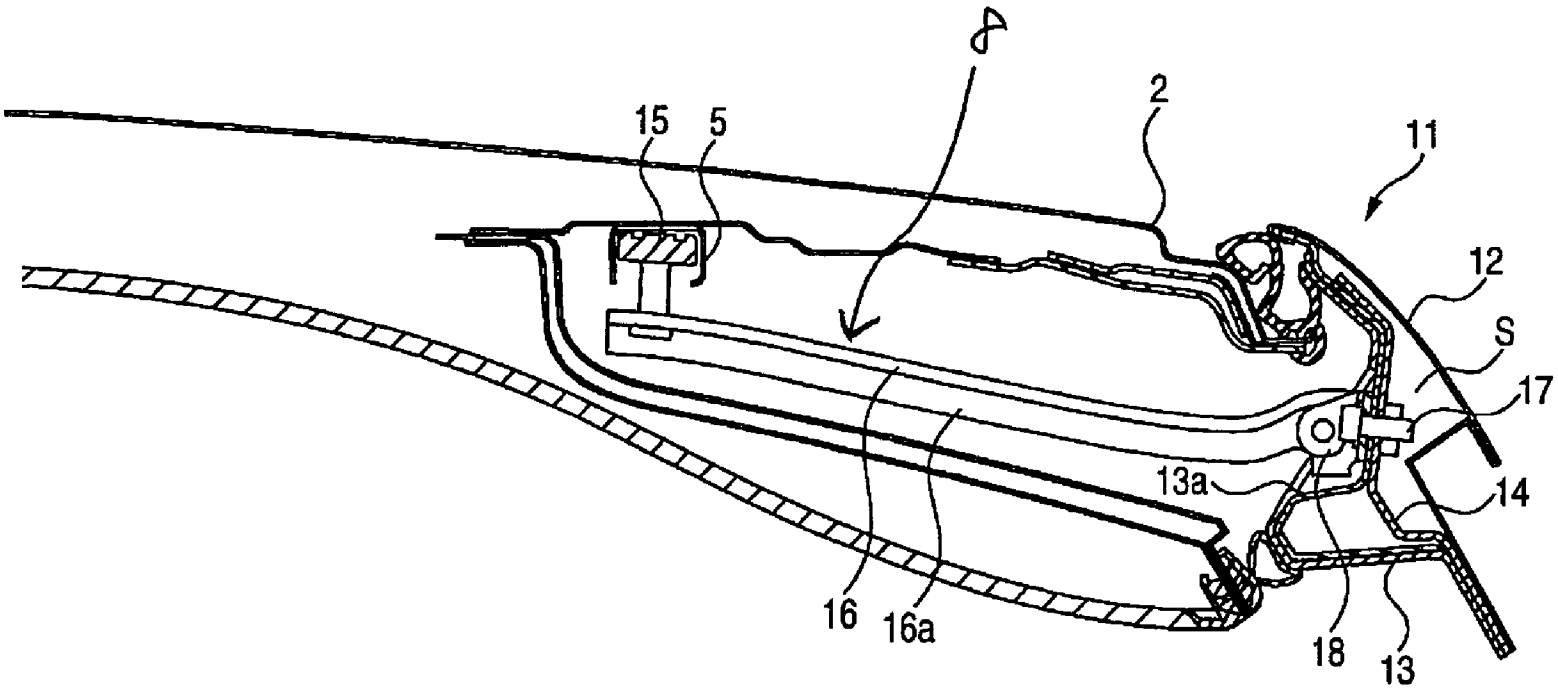
FIG. 2 is a cross-sectional view of FIG.1 taken along cross-section II-II illustrating a cut away view of the arm supporting pillar portion located cross-sectional view of at a front portion of the slide door apparatus.
Figure 3:
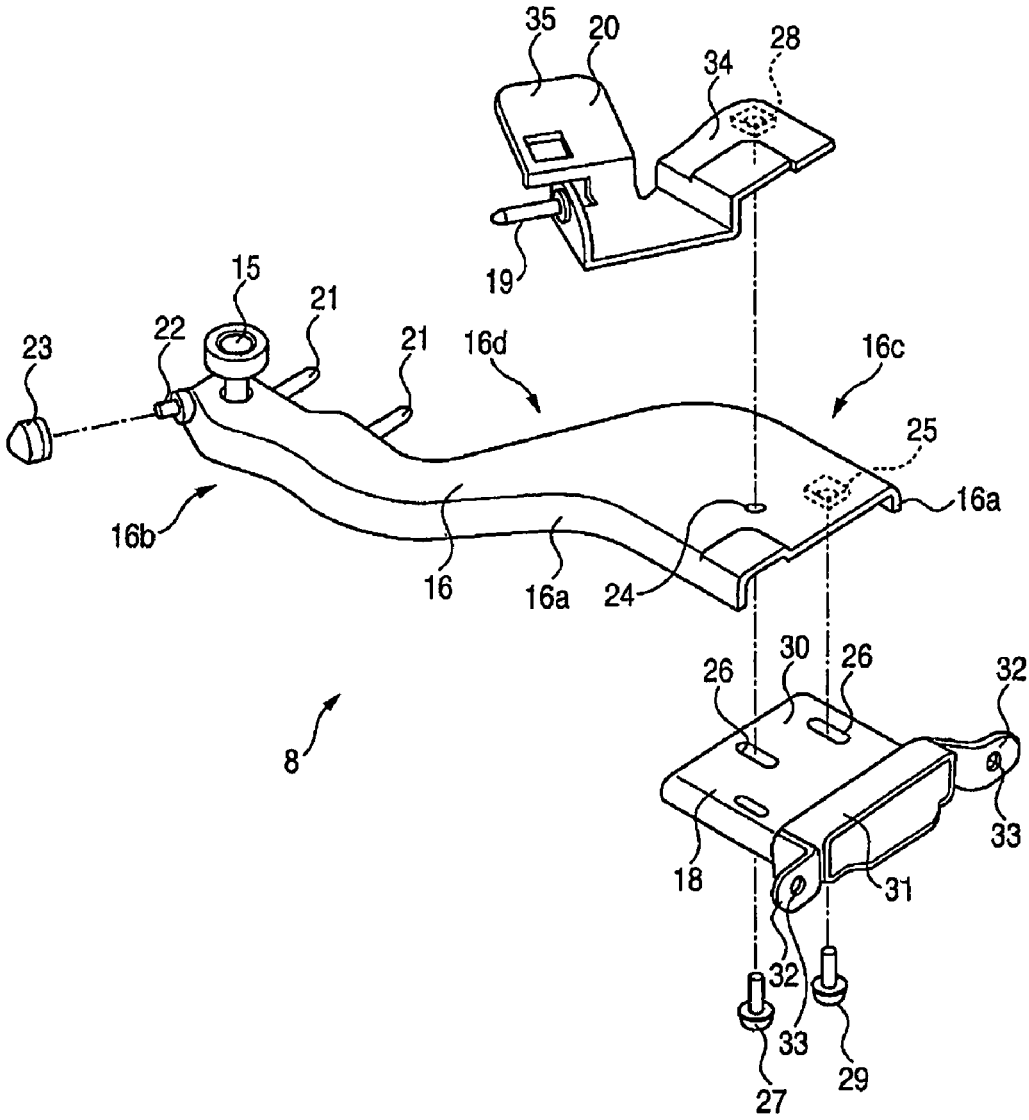
FIG. 3 is an exploded perspective view of an upper arm.
Figure 4:
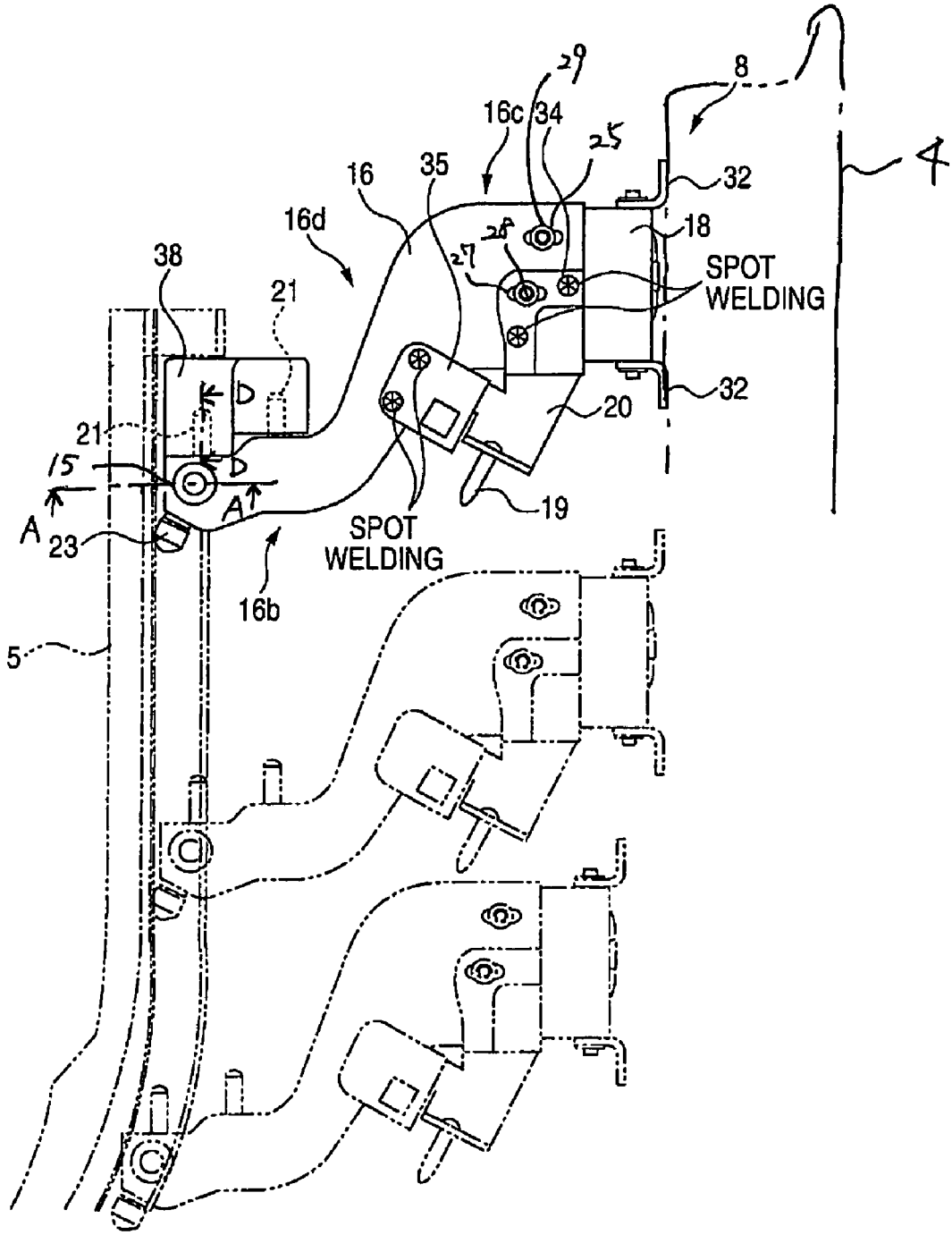
FIG. 4 is a top view of the upper arm.
Figure 5:
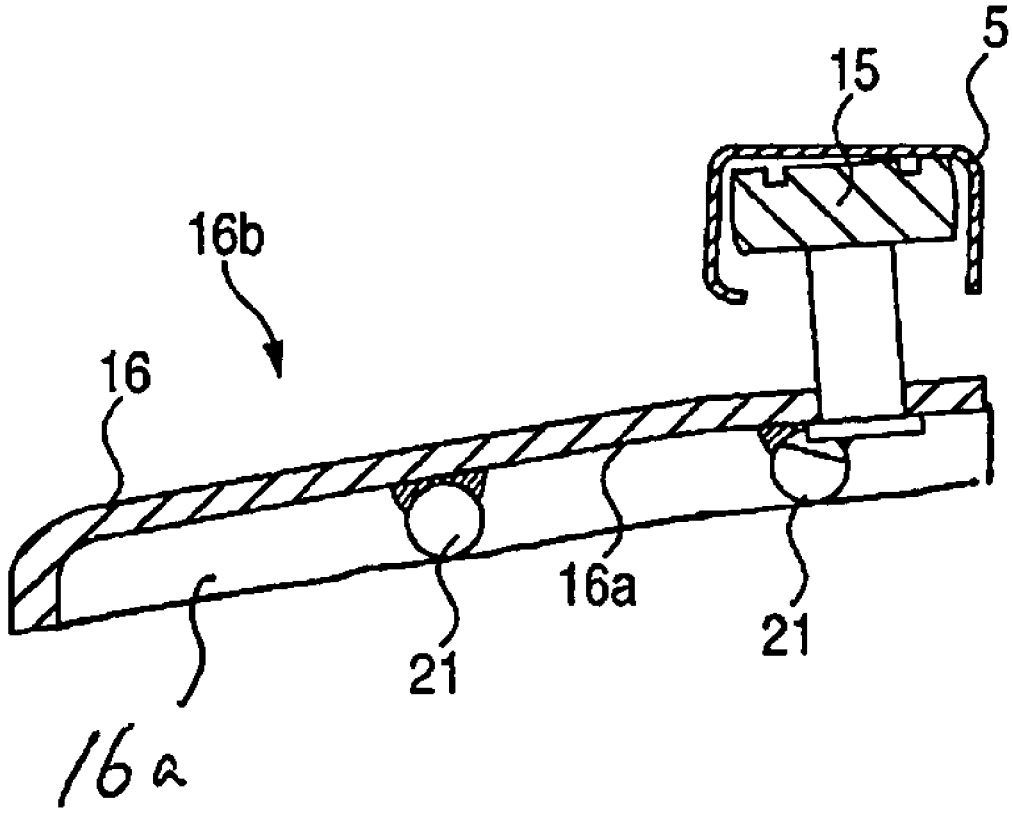
FIG. 5 is an A-A line cross-sectional view of FIG. 4 illustrating a stopper pin portion of the upper arm.
Figure 6:
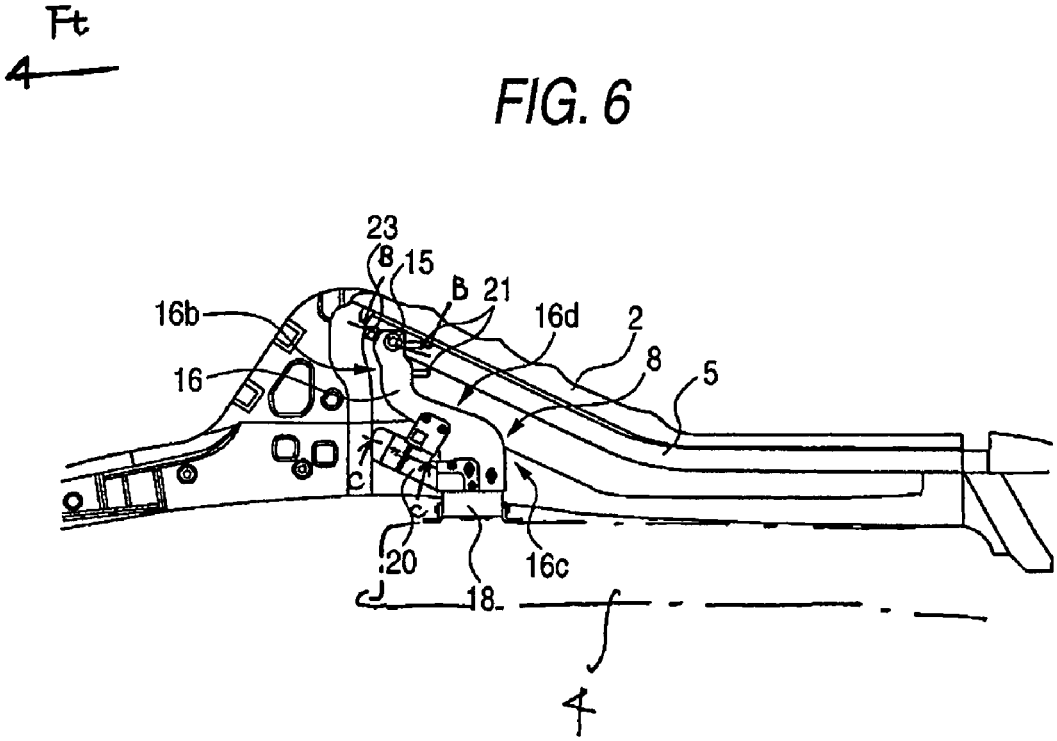
FIG. 6 is a general top view of the upper arm and a vehicle body.
Figure 7:
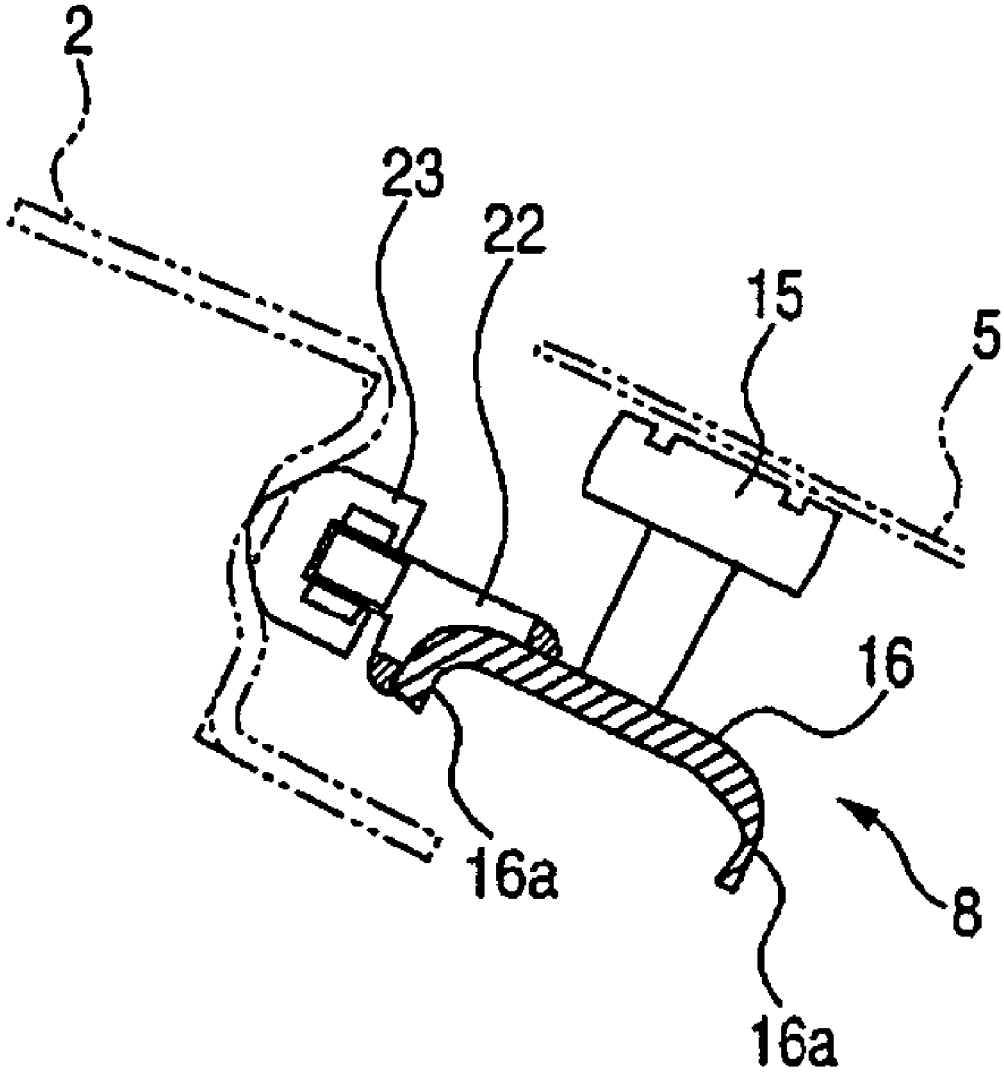
FIG. 7 is a B-B line cross-sectional view of the upper arm of FIG. 6 showing a state in which a cap is in abutment with the vehicle body.
Figure 8:
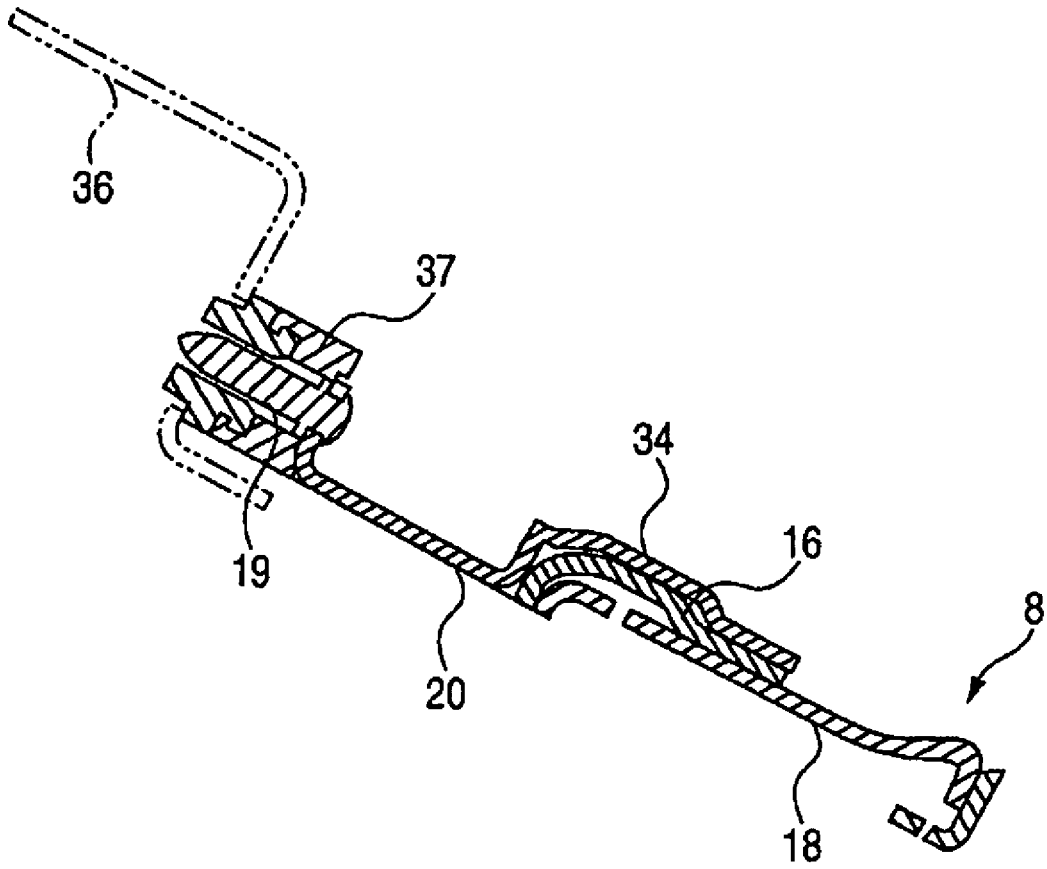
FIG. 8 is a C-C line cross-sectional view of FIG. 6 illustrating the upper arm showing a state in which a catch pin is fitted into a holder.
Figure 9:
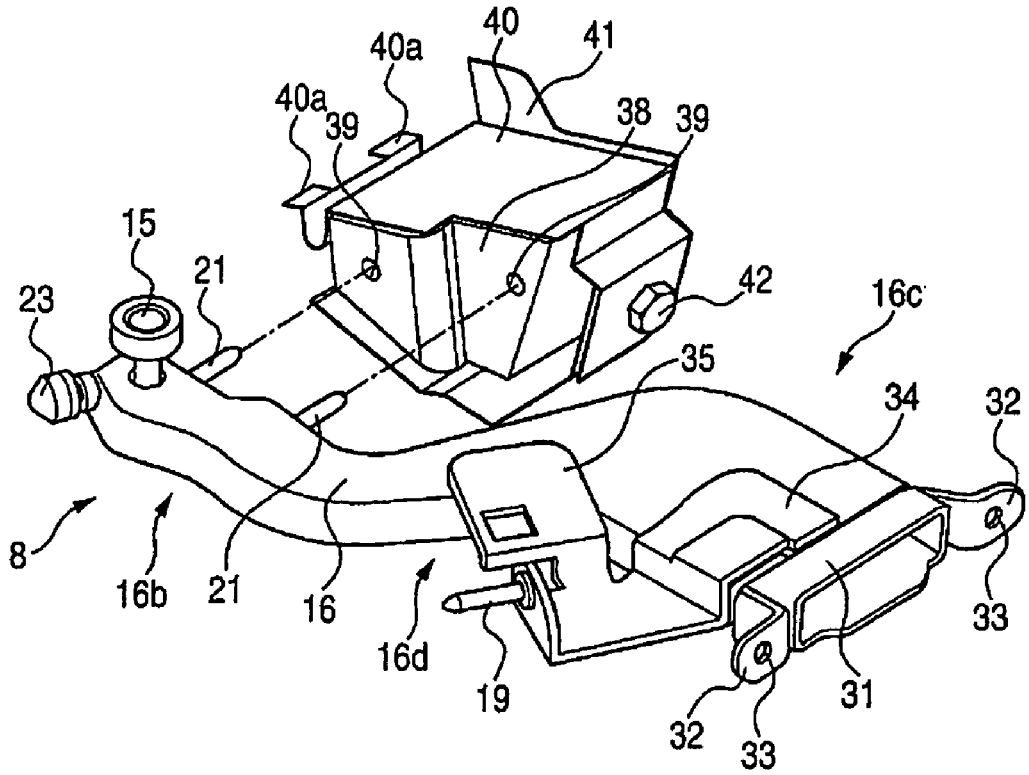
FIG. 9 is an appearance perspective view of the upper arm and the stopper member.
Figure 10:
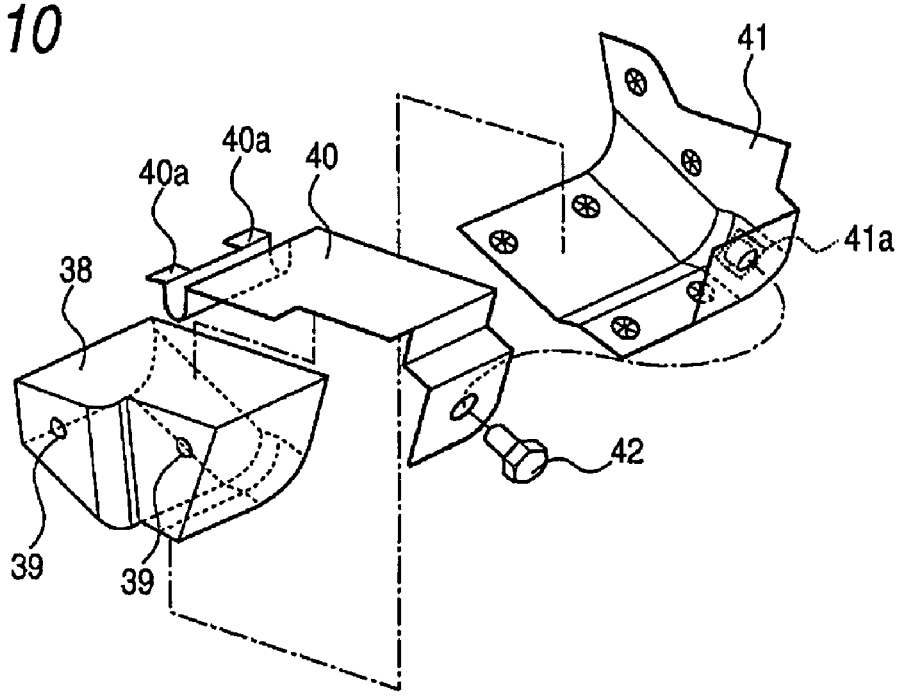
FIG. 10 is an exploded perspective view of a stopper member.
Figure 11:
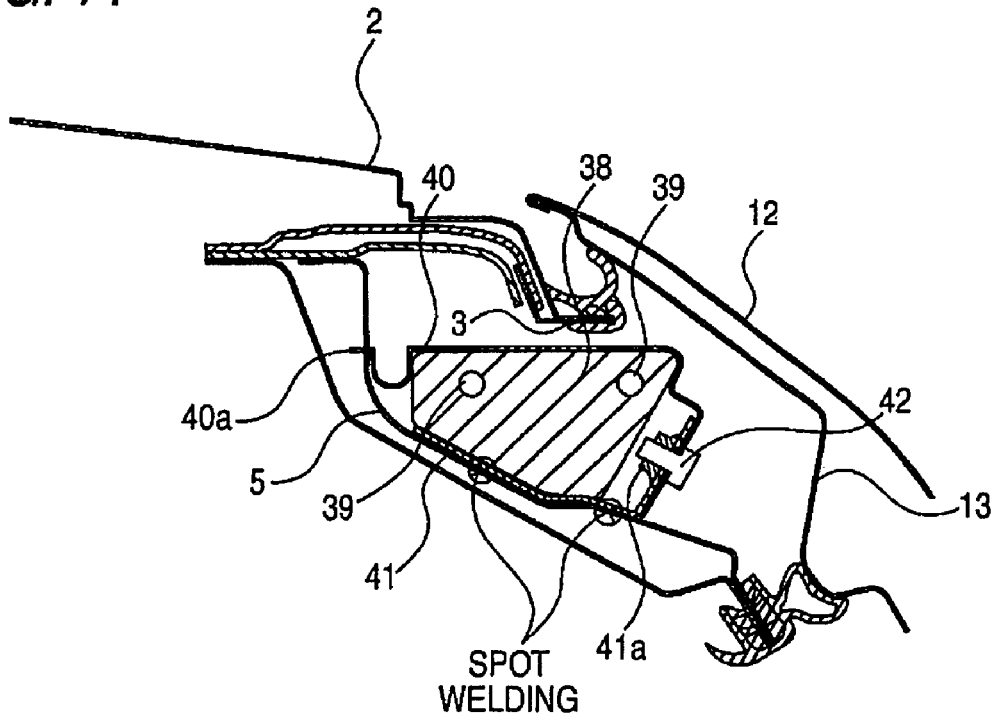
FIG. 11 is a front cross-sectional view of a rear portion of a slide door.
Figure 12:
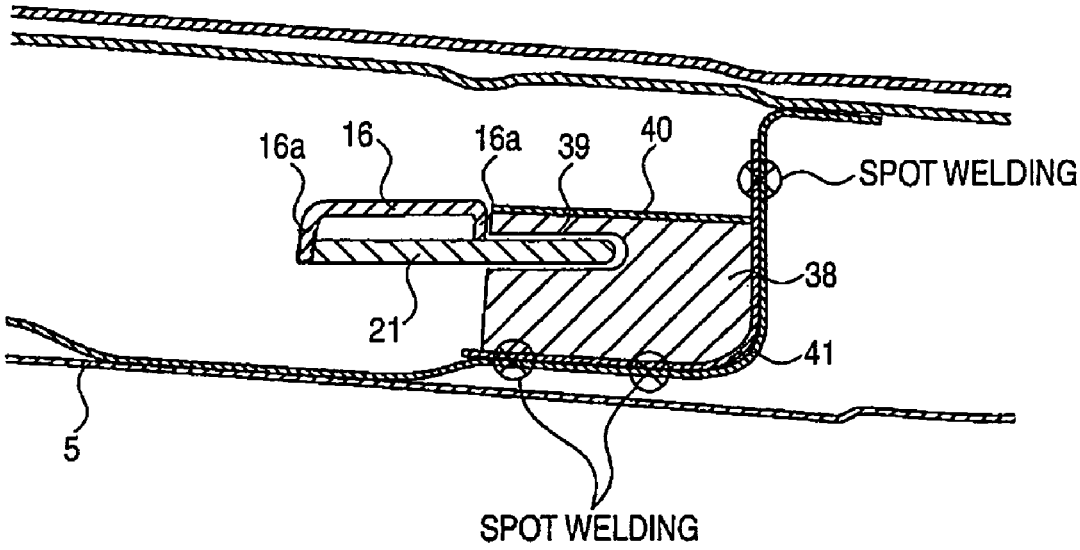
FIG. 12 is a D-D line cross-sectional view of FIG. 4 illustrating the upper arm showing a state in which the stopper pin is fitted into a stopper hole.

FIG. 1 to FIG. 12 shows an embodiment of the invention. FIG. 1 is a perspective view of a general appearance of a motor vehicle provided with a slide door apparatus; FIG. 2 is a front cross-sectional view of a front portion of the slide door apparatus; FIG. 3 is an exploded perspective view of an upper arm; FIG. 4 is a top view of the upper arm; FIG. 5 is an A-A line cross-sectional view of FIG. 4 illustrating a stopper pin portion of the upper arm; FIG. 6 is a general top view of the upper arm and a vehicle body; FIG. 7 is a B-B line cross-sectional view of the upper arm of FIG. 6 showing a state in which a cap is in abutment with the vehicle body; FIG. 8 is a C-C line cross-sectional view of FIG. 6 illustrating the upper arm showing a state in which a catch pin is fitted into a holder; FIG. 9 is an appearance perspective view of the upper arm and the stopper member; FIG. 10 is an exploded perspective view of a stopper member; FIG. 11 is a front cross-sectional view of a rear portion of the slide door; and FIG. 12 is a D-D line cross-sectional view of FIG. 4 illustrating the upper arm showing a state in which the stopper pin is fitted into a stopper hole. In FIG. 2, an upper arm 8 is shown in a simplified manner for description.

As shown in FIG. 1, a vehicle slide door apparatus 1 is used for a one-box type motor vehicle 100 for opening and closing an opening 3 formed on a side of a vehicle body 2 by a square slide door 4 moving in the front-and-rear direction. The vehicle slide door apparatus 1 is adapted to guide the slide door 4 in the front-and-rear direction by three rails including an upper rail 5, a center rail 6, and a lower rail 7 extending in the front-and-rear direction.

In this embodiment, the upper rail 5 and the lower rail 7 are disposed on the vehicle body 2, and the center rail 6 is disposed on the slide door 4. As shown in FIG. 1, the upper rail 5 extends along an upper side of the opening 3, and the lower rail 7 extends along a lower side of the opening 3. The upper rail 5 and the slide door 4 are connected by the upper arm 8 extending in the lateral direction, and the lower rail 7 and the slide door 4 are connected by the lower arm 9 extending in the lateral direction. The center rail 6 and the rear peripheral edge of the opening 3 of the vehicle body 2 are connected by the center arm, not shown.

As shown in FIG. 1, each one of ends of the upper arm 8 and the lower arm 9 is guided in the front-and-rear direction by the upper rail 5 and the lower rail 7. The other ends of the upper arm 8 and the lower arm 9 are fixed to a pillar portion 11 which defines the front peripheral edge of the slide door 4. The pillar portion 11 extends in the vertical direction and, as shown in FIG. 2, defines a closed cross-section S by an outer panel 12 on the exterior side and an inner panel 13 on the interior side at the upper end side. Accordingly, rigidity and strength of the peripheral edge of the slide door 4 is efficiently secured. Disposed between the outer panel 12 and the inner panel 13 is a pillar reinforce 14 so as to divide the closed cross-section S.

As shown in FIG. 2, the inner panel 13 is formed with an insertion hole 13*a* in which the other end of the upper arm 8 is inserted. The other end of the upper arm 8 is fixed to the pillar reinforce 14 of the slide door 4. The upper arm 8 is formed into substantially a flat shape in front view (see FIG. 2), and is formed so as to increase in width from one end (interior side) to the other end (exterior side) (see FIG. 3).

As shown in FIG. 3, the upper arm 8 includes an arm body 16 having a roller 15 to be engaged with the upper rail 5 at one end, a fastening portion 18 connected to the other end of the arm body 16 and fastened to the pillar reinforce 14 by a bolt 17, and an arm guiding member 20 provided on top of the other end of the arm body 16 and having a catch pin 19 projecting obliquely toward the front.

The arm body 16 is formed into a plate shape extending substantially in the lateral direction, and is formed with flanges 16*a* projecting downward from the front edge and the rear edge. As shown in FIG. 4, the arm body 16 includes one end portion 16*b* extending at one end substantially in the lateral direction, the other end portion 16*c* formed on the rear side of the one end portion 16*b* and extending substantially in the lateral direction at the other end, and a curved portion 16*d* connecting the one end portion 16*b* and the other end portion 16*c*. In this embodiment, as shown in FIG. 4, the curved portion 16*d* is formed so as to increase in width toward the other end.

Two stopper pins 21 extending in substantially in parallel with each other are secured on the lower portion on the one end of the arm body 16 so as to project rearward at a distance in the lateral direction. In this embodiment, the respective stopper pins 21 as the first projection and the second projection are secured to the respective flange 16*a* at the front and rear by welding. The respective stopper pins 21 are formed substantially into a cylindrical shape, and the corners at the rear end are rounded. As shown in FIG. 5, the respective stopper pins 21 are disposed at a predetermined distance in longitudinal direction of the arm body 16.

As shown in FIG. 3, formed at the front portion on the one end of the arm body 16 is a projecting pin 22 projecting obliquely forward toward the interior side. A cap 23 is attached to the projecting pin 22 so as to come into contact with a panel on the side of the vehicle body 2 as shown in FIG. 7, when the slide door 4 is moved to the frontmost position in movable range of the side door as shown in FIG. 6.

Provided on top of the one end of the arm body 16 is a roller 15 to be engaged with the upper rail 5. In this embodiment, as shown in FIG. 5, the upper rail 5 is provided with a portion opening downward and the roller 15 projecting from the upper surface of the upper arm 8 through the opening is fitted inside the upper rail 5. The roller 15 comes into abutment with the side wall of the upper rail 5 and rotates about an axis extending in substantially the vertical direction.

As shown in FIG. 3, a bolt insertion hole 24 and a weld nut 25 for fixation with the fastening portion 18 are provided on the other end of the arm body 16. The fastening portion 18 is formed with two long holes 26 elongated in the longitudinal direction of the upper arm 8 corresponding to the insertion hole 24 and the weld nut 25. A bolt 27 to be inserted into the bolt insertion hole 24 is screwed into a weld nut 28 secured to the lower surface of the arm guiding member 20. A bolt 29 inserted into a different long hole 26 from the long hole 26 in which the bolt 27 is inserted is screwed into the weld nut 25 secured to the lower surface of the arm body 16. In other words, the arm body 16 and the fastening portion 18 can be assembled by shifting longitudinally by an amount corresponding to the length of the respective long holes 26.

As shown in FIG. 3, the fastening portion 18 includes a joint portion 30 formed with the respective long holes 26 and a fixed portion 31 located adjacently to the joint portion 30 on the side of the other end, and the joint portion 30 and the fixed portion 31 are free to rotate with respect to each other about an axis extending in the front-and-rear direction. The fixed portion 31 is formed with extending portions 32 extending outward in the front-and-rear direction from the front and the rear at the other end thereof. Each extending portion 32 is formed with a bolt hole 33, and is adapted to be screwed to the pillar reinforce 14 of the slide door 4 by the bolt 17.

As shown in FIG. 4, the arm guiding member 20 is secured to the arm body 16 side also by spot welding in addition to the aforementioned bolt 27. The arm guiding member 20 includes a first plate-shaped portion 34 having the weld nut 28 secured thereto and fixed to the other end 16*c* of the arm body 16, and a second plate-shaped portion 35 to be fixed to the curved portion 16*d* of the arm body 16. The first plate-shaped portion 34 and the second plate-shaped portion 35 are fixed to the arm body 16 by spot welding respectively. The respective plate-shaped portions 34, 35 are connected forwardly of the other end 16*c* of the arm body 16 and the connecting portion is provided with the aforementioned catch pin 19 extending forward. As shown in FIG. 8, the catch pin 19 is fitted into a holder 37 of a catcher bracket 36 provided on a reinforce of the vehicle body 2 when the slide door 4 is moved to the frontmost position in the movable range of the slide door.

As shown in FIG. 9, the respective stopper pins 21 are received in stopper holes 39 on a stopper member 38 as the proximity member disposed at the rear end of the upper rail 5. In this embodiment, the two stopper holes 39 are formed separately corresponding to the respective stopper pins 21. The stopper member 38 formed of rubber member comes into abutment with the upper arm 8 when the slide door 4 is moved to the rearmost position in the movable range of the slide door. Then, the respective stopper pins 21 projecting from the upper arm 8 are received in the stopper member 38 in a state in which the upper arm 8 and the stopper member 38 are in abutment with each other (see FIG. 12). The stopper member 38 is fixed to the upper rail 5 by a first bracket 40 covering the upper side and a second bracket 41 for covering the lower side and the rear side. As shown in FIG. 10, the respective brackets 40, 41 are fastened by a bolt 42 at the side portions thereof on the exterior side. On the interior side of the first bracket 40 is formed with a pair of front and rear claws 40*a* to be engaged with the side wall of the upper rail 5. As shown in FIG. 11, the second bracket 41 includes a weld nut 41*a* secured thereto for screwing on the bolt 42 and is fixed to the upper rail 5 by spot welding.

In the vehicle slide door apparatus 1 configured as described above, when the slide door 4 is moved to the rearmost position in the movable range of the slide door, the respective stopper pins 21 are received in the stopper holes 39 on the stopper member 38. At this time, since the respective stopper pins 21 are apart from each other in a longitudinal direction of the upper arm 8, even when a load is applied from the stopper member 38 side to the upper arm 8 side, the load can be received by the span between the respective stopper pins 21, whereby the upper arm 8 is prevented from excessively twisted and the moment generated on the upper arm 8 can be reduced. As shown in FIGS. 4 and 9, for example, the stopper member 38 has a stepped region between two laterally spaced face sections in which stopper holes 39 are respectively formed. There is further shown a stepped region in arm 8 which rests within the stepped region of the stopper member as seen from FIG. 2.

Therefore, even though the upper arm 8 is adapted to pivot, the slide door 4 can be stably supported at the rearmost position in the movable range of the slide door. In other words, for example even when the door is opened or closed by the passenger, the slide door 4 is prevented from being unstable, and hence quietness in opening and closing the door can be improved.

According to the vehicle slide door apparatus 1 of this embodiment, since the first projection and the second projection are two stopper pins 21 extending substantially in parallel with each other, the slide door 4 can be stably supported at the rearmost position in the movable range by a minimum projecting portion.

According to the vehicle slide door apparatus 1 of this embodiment, the upper arm 8 is reinforced by the respective stopper pins 21, and rigidity and strength of the upper arm 8 is improved. In this embodiment, since the respective stopper pins 21 extend in the direction of width of the upper arm 8, rigidity and strength can be improved not only locally, but also entirely, which is quite advantageous for practical use.

According to the vehicle slide door apparatus 1 of this embodiment, the section modulus of the upper arm 8 is increased by the flanges 16*a* extending upward or downward at the front edge and the rear edge thereof. In addition, since the respective stopper pins 21 are secured to the respective flanges 16*a* by spot welding, the closed section is defined by the arm body, the respective flanges 16*a*, and the respective stopper pins 21, and hence the section modulus is outstandingly improved. Therefore, rigidity and strength of the upper arm 8 can be outstandingly improved.

According to the vehicle slide door apparatus 1 of this embodiment, since the stopper member 38 is formed of rubber, when the slide door 4 hits against the stopper member 38 at the rearmost position in the movable range of the slide door, the stopper member 38 can absorb the impact. In addition, since the stopper member 38 is installed on the upper rail 5, positioning accuracy of the stopper member 38 is improved in comparison with the case in which the stopper member 38 is installed at other positions of the vehicle body 2.

Although an example in which the invention is applied to the upper rail 5 or the upper arm 8 is shown in the aforementioned embodiment, the invention can be applied to the lower rail 7 and the lower arm 9, or the center rail 6 and the center arm as a matter of course.

Figure 13:
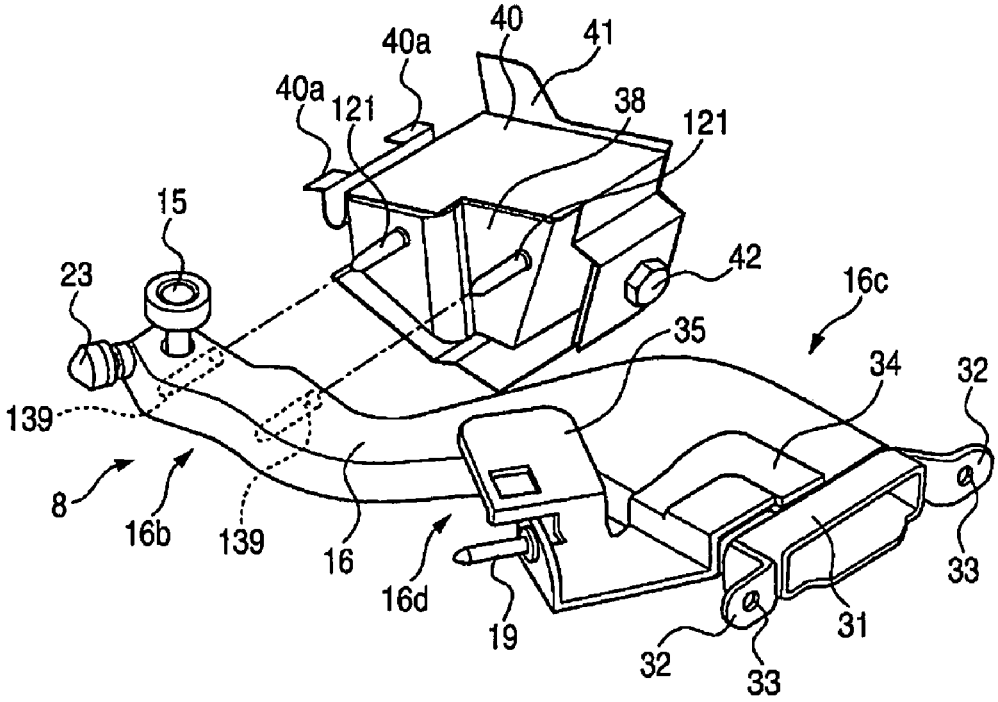
FIG. 13 is an appearance perspective view of the upper arm and the stopper member according to a modification.
Figure 14:
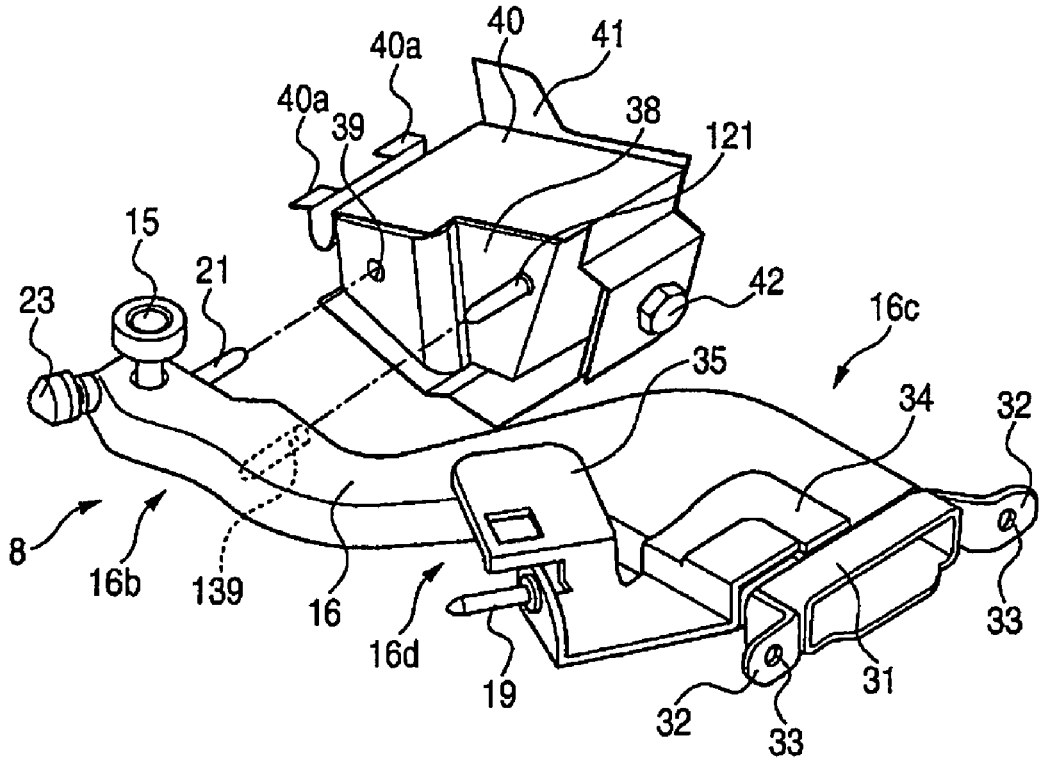
FIG. 14 is an appearance perspective view of the upper arm and the stopper member according to a modification.

Although an example in which both of the respective stopper pins 21 are formed on the upper arm 8 is shown in the aforementioned embodiment, as shown in FIG. 13 for example, it is also possible to form both of stopper pins 121 on the stopper member 38 and form stopper holes 139 in which the respective stopper pins 121 are received on the upper arm 8. Alternatively, as shown in FIG. 14 for example, a structure in which one of the stopper pins 21 is formed on the upper arm 8 and the other stopper pin 121 is formed on the stopper member 38 is also applicable.

Although an example in which the stopper pins 21 are formed as the first and second projections respectively is shown in the aforementioned embodiment, the respective projections may be, for example, projections formed integrally with the arm member 16 instead of the pin shape. Although the example showed the case in which there are two projections, it is also possible to provide three or more projections.

Figure 15:
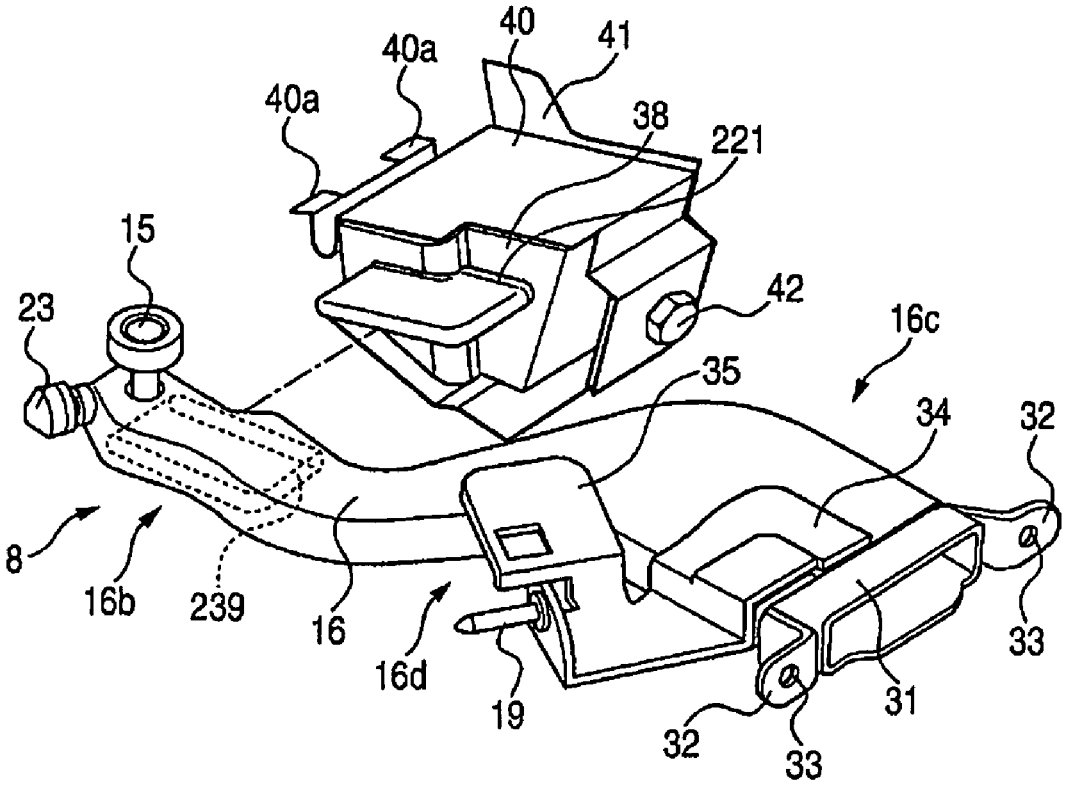
FIG. 15 is an appearance perspective view of the upper arm and the stopper member according to a modification.
Figure 16:
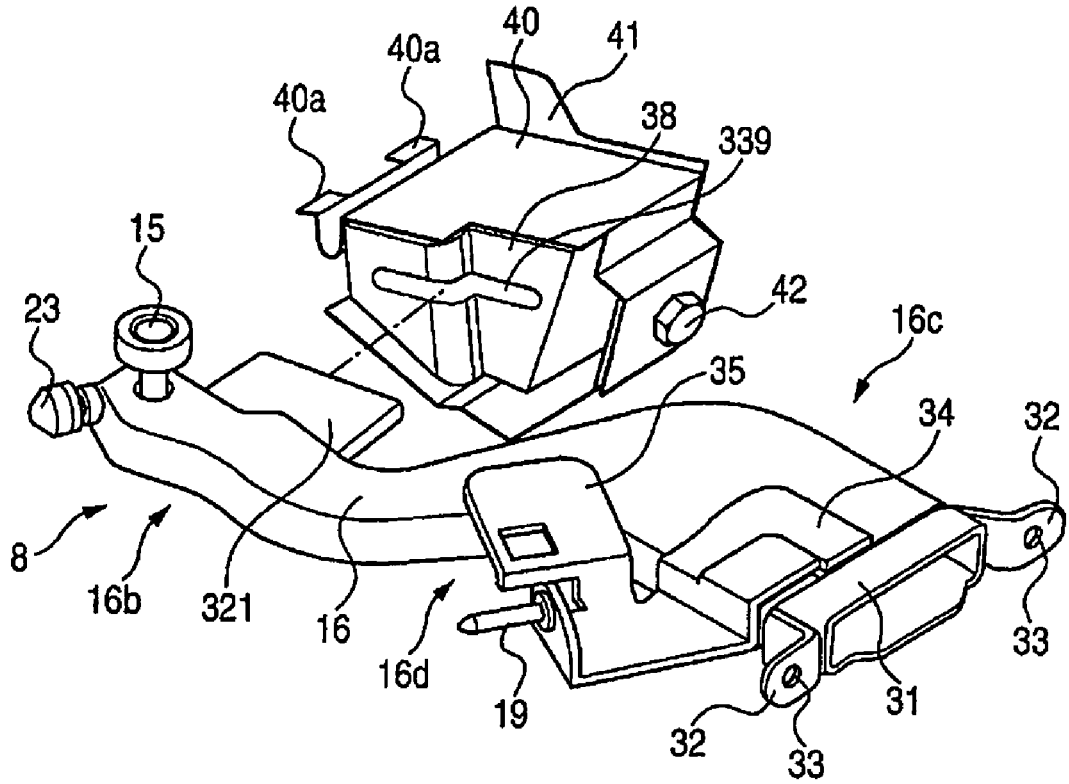
FIG. 16 is an appearance perspective view of the upper arm and the stopper member according to a modification.

In addition, as long as the projections are formed so as to extend in a longitudinal direction of the upper arm 8, even though there is only one projection, the same effects and advantages as the aforementioned embodiment are achieved. For example, as shown in FIG. 15, it is also possible to form a projection 221 on the stopper member 38 so as to extend in a longitudinal direction thereof, and form stopper hole 239 for receiving the same on the arm body 16. Alternatively, as shown in FIG. 16 for example, it is possible to form a projection 321 on the arm body 16 so as to extend in a longitudinal direction thereof and form a stopper hole 339 for receiving the same on the stopper member 38. In this case as well, when a load is applied from the stopper member 38 side to the upper arm 8 side, the load from the stopper member 38 side can be received by a predetermined span basis, whereby the upper arm 8 is prevented from excessively twisted, and the moment generated on the upper arm 8 can be reduced.

Although an example in which the stopper holes 39 are formed on the stopper member 38 which comes into abutment with the upper arm 8 is shown in the aforementioned embodiment, the projection or the receiving portion may be formed on a member different from the stopper member 38 as the proximity member which contacts to the upper arm 8 when the slide door 4 is moved to the rearmost position in the movable range of the slide door. Other fine and detail structures may also be modified as needed as a matter of course.

What is claimed is:

1. A vehicle slide door apparatus comprising:

a slide door moving in a front-and-rear direction of the vehicle for opening and closing an opening formed on a side of the vehicle;

a rail provided on the vehicle body extending along one of an upper side and a lower side of the opening;

an arm guided by the rail in the front-and-rear direction at one end thereof and fixed to the slide door at another end thereof;

a proximity member that contacts the arm when the slide door is moved to a rearmost position in a movable range of the slide door;

a first projection formed on one of the arm and the proximity member so as to project therefrom for being received by the other one of those in a state in which the arm is in the proximity of the proximity member; and a second projection formed on one of the arm and the proximity member at a distance from the first projection in a longitudinal direction of the arm for being received by the other one of those in a state in which the arm contacts to the proximity member.

2. The vehicle slide door apparatus according to claim 1, wherein one of the first projection and the second projection is formed on the arm and the other one of those is formed on the proximity member.

3. The vehicle slide door apparatus according to claim 2, wherein the first projection and the second projection are two stopper pins extending substantially in parallel with each other.

4. The vehicle slide door apparatus according to claim 3, wherein the respective stopper pins extend at least in the direction of the width of the arm.

5. The vehicle slide door apparatus according to claim 1, wherein the first projection and the second projection are two stopper pins extending substantially in parallel with each other.

6. The vehicle slide door apparatus according to claim 5, wherein the respective stopper pins extend at least in the direction of the width of the arm.

7. The vehicle slide door apparatus according to claim 1, wherein the second projection is located between the upper rail and the slide door.

8. The vehicle slide door apparatus according to claim 1, wherein the first projection is located below the upper rail and the second projection is located between the upper rail and the slide door.

9. The vehicle slide door apparatus according to claim 1, wherein the proximity member is formed of rubber.

10. The vehicle slide door apparatus according to claim 1, wherein the proximity member is fixed to the upper rail.

11. The vehicle slide door apparatus according to claim 1, further comprising:

a first stopper hole on one of the arm and the proximity member so as to receive said first projection; and a second stopper hole on one of the arm and the proximity member so as to receive the second projection.

12. The vehicle slide door apparatus according to claim 1 wherein said arm is fixed to the slide door by a pivoting fastener part.

13. The vehicle slide door apparatus according to claim 1 wherein said proximity member has a stepped region defined by a first forward face section, a second forward face section, and a step section extending between said first and second face sections, and said arm has a stepped portion designed to nest within the stepped region of said proximity member.

14. The vehicle slide door apparatus according to claim 13 wherein said first and second projections are positioned as opposite sides of said step section of said proximity member.

15. A vehicle slide door apparatus comprising:

a slide door moving in a front-and-rear direction of the vehicle for opening and closing an opening formed on a side of the vehicle;

a rail provided on the vehicle body extending along one of an upper side and a lower side of the opening;

an arm guided by the rail in the front-and-rear direction at one end thereof and fixed to the slide door at one end;

a proximity member that contacts the arm when the slide door is moved to the rearmost position in a movable range of slide door; and a projection which is formed on one of the arm and the proximity member so as to project therefrom and extend in a longitudinal direction of the arm for being received by the other one of those in a state in which the arm contacts to the proximity member, wherein the width of the projection in the longitudinal direction of the arm is larger than that of the upper rail.

16. The vehicle slide door apparatus according to claim 15, wherein the proximity member is formed of rubber.

17. The vehicle slide door apparatus according to claim 15, wherein the proximity member is fixed to the upper rail.

18. The vehicle slide door apparatus according to claim 15, further comprising:

a stopper hole on one of the arm and the proximity member so as to receive the projection.

19. The vehicle slide door apparatus according to claim 15 wherein said arm is fixed to the slide door by a pivoting fastener part.

20. The vehicle slide door apparatus according to claim 15 wherein said proximity member has a stepped region defined by a first forward face section, a second forward face section, and a step section extending between said first and second face sections, and said arm has a stepped portion designed to rest within the stepped region of said proximity member, wherein said projection extends across to opposite sides of said step section of said proximity member.

21. A vehicle slide door apparatus comprising:

a slide door moving in a front-and-rear direction of the vehicle for opening and closing a opening formed on a side of the vehicle;

a rail supported by the vehicle body and extending in the front-and-rear direction;

an arm guided by the rail in the front-and-rear direction at one end thereof and pivotably fixed to the vehicle at another end thereof;

a proximity member that contacts the arm when the slide door is moved to an end position in a movable range of the slide door;

a projection device formed on at least one of the arm and the proximity member, and said projection device having a single projection or multiple projections, and which projection device mates with a recess or recesses formed in at least one of said arm and said proximity member, and said projection device having opposite side edges spaced apart in a longitudinally spaced apart arrangement along said arm, which spaced apart arrangement precludes relative rotation of said arm and proximity member once mating occurs.

* * * * *